United States Patent [19]

Merrell et al.

[11] Patent Number: 4,796,548

[45] Date of Patent: Jan. 10, 1989

[54] METHOD OF CONDITIONING FIRESIDE FOULING DEPOSITS USING SUPER LARGE PARTICLE SIZE MAGNESIUM OXIDE

[75] Inventors: Gene A. Merrell, Huntingdon Valley; Richard J. Sujdak, Morrisville, both of Pa.

[73] Assignee: Betz Laboratories, Inc., Trevose, Pa.

[21] Appl. No.: 608,053

[22] Filed: May 8, 1984

[51] Int. Cl.[4] ..... F23J 11/00

[52] U.S. Cl. ..... 110/343; 110/345; 110/347

[58] Field of Search ..... 110/342, 343, 344, 345, 110/347; 44/1 SR, 4, 5

[56] References Cited

U.S. PATENT DOCUMENTS

| | | | |
|---|---|---|---|
| 3,249,075 | 5/1966 | Nelson et al. | 110/343 |
| 3,837,820 | 9/1974 | Kukin | 110/343 |
| 4,245,573 | 1/1981 | Dixit et al. | 110/343 |
| 4,253,408 | 3/1981 | Kramer | 110/343 |
| 4,329,324 | 5/1982 | Jones | 110/345 |
| 4,369,719 | 1/1983 | Engstrom et al. | 110/345 |
| 4,372,227 | 2/1983 | Mahoney et al. | 110/343 |
| 4,428,310 | 1/1984 | Kekishi et al. | 110/342 |
| 4,450,777 | 5/1984 | Wolfrum et al. | 110/342 |
| 4,458,606 | 7/1984 | Merrell | 110/347 |

FOREIGN PATENT DOCUMENTS 1551700 4/1970 Fed. Rep. of Germany ..... 110/343

OTHER PUBLICATIONS

"How More Ash Makes Less" J. E. Radway, American Chem. Society, vol. 12, No. 4, Apr. 1978, pp. 388–391.

"Selecting and Using Fuel Additives", J. E. Radway, Chemical Engineering, Jul. 14, 1980, pp. 155–160.

"Effectiveness of Fireside Additives in Coal-Fired Boilers", J. E. Radway, Power Engineering, Apr. 1978, pp. 72–75.

*Primary Examiner*—Steven E. Warner

*Attorney, Agent, or Firm*—Alexander D. Ricci

[57] ABSTRACT

In a coal fired boiler of the type having a combustion zone in which said coal is fired, a convection zone located downstream from said combustion zone and having a plurality of heater tubes disposed therein adapted to heat water or steam disposed therein, and in which convection zone combustion residues emanating from said coal have a tendency to stick to or agglomerate upon said tubes, a method of decreasing said tendency to stick or agglomerate, comprising burning said coal in the presence of an additive consisting essentially of super large magnesium oxide particles, a major mass fraction of which is about 150 microns in diameter or greater.

12 Claims, No Drawings

METHOD OF CONDITIONING FIRESIDE FOULING DEPOSITS USING SUPER LARGE PARTICLE SIZE MAGNESIUM OXIDE

FIELD OF THE INVENTION

The present invention pertains to a method of reducing the adverse effects of solid fuel combustion residues on those structures normally contacted thereby. The invention is particularly, although not exclusively, advantageous in connection with use in coal-fired boiler units so as to increase the friability of combustion residues which may normally adhere to boiler surfaces. The invention also serves to minimize fouling problems normally attendant upon combustion of the fuel.

BACKGROUND OF THE INVENTION

When solid fuels are burned in boiler furnaces and the like, the residues emanating from the fuel collect on the internal surfaces of the boiler to impede heat transfer functions, and result in increased boiler downtime for cleaning and repair. For instance, undesirable slag deposits, may be formed in the high temperature firebox area, requiring boiler shutdown for complete removal thereof.

Ash residues often tenaciously stick to fireside boiler tubes, economizers, and preheaters. These ash deposits accumulate and block passages through which the hot boiler gases are designed to pass.

Ash deposits are periodically cleaned via soot blower devices or the like. However, to the extent that the ash agglomeration is more tenacious than the cleaning draft or force exerted by the soot blowers, severe problems are encountered. This problem has become magnified in recent years as the ash level of utilized fuels has increased due to such factors as the low availability and excessive cost of high quality fuels. These factors result in ever increasing economic pressures to burn lower cost, lower quality fuels.

SUMMARY OF THE INVENTION

The present invention provides a method for decreasing the tendency of solid fuel combustion residues to adhere to internal furnace surfaces by utilization of a super large particle size magnesium oxide fuel additive. We have surprisingly found that when a majority of the magnesium oxide particles (based upon mass) have a particle size diameter of at least 150 microns, sintered pelletized ashes treated therewith exhibit significant reduction in the strength needed to burst such pellets when compared to pellets treated with conventional, small size magnesium oxide particles.

PRIOR ART

The use of magnesium oxide to minimize boiler fuel-related fouling problems is not new. German Offenlegungsschrift No. 1,551,700, deals with oil-fired boilers and calls for utilization of magnesium particles that pass through a 1.6 mm sieve and which are retained by a 150 micron sieve. The disclosed purpose for this MgO addition is so that a heat-reflecting layer of magnesium oxide is formed along the radiant wall tubes to result in higher furnace operating temperatures in the boiler convection zone—in contrast to the purpose of the present invention which is to provide a frangible ash.

In "Effectiveness of Fireside Additives in Coal-Fired Boilers", *Power Engineering,* April 1978, pages 72–75, J. E. Radway, it is stated that injection of minor quantities of MgO into a boiler superheater area has resulted in cleaner convection surfaces and reduced corrosion. The article states that the efficacy of the dispersed magnesia is probably due to its fine particle size.

Similarly, in "Selecting and Using Fuel Additives", *Chemical Engineering,* July 14, 1980, pages 155–160, J. E. Radway, the author indicates that the use of "coarse" magnesium oxide has proven uneconomical. Within the context of this article, it is thought that the word "coarse" would apply to particles having sizes on the order of from 2 microns to about 20. In fact, in "How More Ash Makes Less," *Environmental Science & Technology,* Volume 12, Number 4, April 1978, pages 388–391, J. E. Radway, the author indicates that magnesite (MgO) additive particles of 0.7 microns were about twice as effective as magnesite of 2.0 microns, thus leading the skilled artisan in a direction which has proven contrary to the inventive principles herein disclosed and claimed.

Of lesser interest is U.S. Pat. No. 3,249,075 (Nelson) which teaches the use of silica and compounds of silica with at least one oxide selected from the group consisting of sodium oxide, potassium oxide, calcium oxide, magnesium oxide, titanium dioxide and aluminum oxide to the fuel combustion products.

Other patents which may be of interest include U.S. Pat. Nos. 3,817,722 (Scott); 2,059,388 (Nelms); 4,372,227 (Mahoney et al); 4,329,324 (Jones); and 4,369,719 (Engstrom et al).

DETAILED DESCRIPTION OF THE INVENTION

Despite the above-noted prior art efforts, there remains a need in the art for a fuel additive, adapted specifically for utilization in conjunction with solid fuels, which additive minimizes fouling tendencies and provides for more "friable" ash combustion residues. Such "friable" deposits, when they adhere to internal boiler structure, may be more readily eliminated from these structures by soot blowers and the like.

As used herein, the term "fireside" refers to heat transfer surfaces in those boiler sections that are in contact with the hot combustion gases. These "fireside" sections conventionally include the economizer, convection zone, superheater, and furnace sections of the boiler.

The present application is therefore directed toward a boiler fuel additive which is adapted to provide a more "friable" ash deposit in the fireside sections of the boiler.

Specifically, the fuel additive of the present invention comprises super large particle size MgO particles wherein a majority (i.e. >50%) of the MgO, by mass, has particle sizes of 150 microns in diameter and greater. Such super large MgO particles significantly reduce the strength needed to burst pellets of coal combustion ash residue. Hence, it is postulated that such products will be effective in minimizing the tendency of coal combustion residue ashes to adhere to internal boiler surfaces. Use of such super large size MgO particles will, it is thought, render any resulting combustion ash deposits frangible so that the ashes may be readily removed from the internal boiler structure by soot blowers and the like.

At present, two commercially available MgO products comprise a majority of such super large particles and have proven efficacious in laboratory studies. One efficacious product is available from Baymag Mines, Calgary Alberta Canada under the trademark "Baymag 30". This product has a particle size distribution as follows:

| Particle Size (microns) | Percent (By Mass) Greater Than |
|---|---|
| 75 | 84 |
| 106 | 72 |
| 150 | 54 |
| 250 | 23 |
| 300 | 13 |

Another product, known to be efficacious in the laboratory at present, is available from Martin Marietta Chemicals under the trademark MagChem 10 Prilled 30. It has the following particle size distribution:

| Particle Size (microns) | Percent (By Mass) Greater Than |
|---|---|
| 150 | 98 |
| 250 | 96 |
| 300 | 90 |
| 1,000 | 4 |

The super large size MgO particles of the invention may be admitted into any type of furnace firing solid fuels, such as coal, wood, peat, sewage and municipal waste burning furnaces. Ideally, these additives are used in conjunction with coal-fired boilers. All types of boilers including cyclone, pulverized coal, and stoker fed boilers may be beneficially treated with the MgO additive of the present invention.

In coal fired boilers of the type having a combustion zone in which the coal is fired, and a convection zone disposed downstream from the combustion zone in which convection zone heater tubes are positioned to heat water to form steam or to heat steam to form superheated steam, the tendency is for sticky, tenacious ash deposits to form on or around these heater tubes. To minimize the deleterious effects of these deposits, the coal is fired in the presence of the fuel additive either by adding the additive directly to the coal or by injecting the additive upstream from the convection zone so that the turbulent gas forces will carry the additive to the desired working area.

The additives may either be shot fed or continuously fed. In cyclone boilers it is advantageous to admit the super large sized MgO particles into the upper furnace area, just upstream from the convection tubes. The additive will be distributed through the boiler by the turbulent flow of the combustion gases. For stoker and pulverized coal burning units, the additive may be fed directly with the coal in lieu of or in addition to possible feeding upstream from the boiler convection section.

The amount of additive to be used will depend upon many factors, such as the flue gas temperature at the collecting surface, the design of the boiler, the burner configuration, and, of course, the impurity content of the fuel. The higher the flue gas temperature, the greater is the tendency toward the formation of deposits. With narrowly spaced superheater tubes, the tendency to clog the passage between the tubes is greater. The greater the impurity content of the fuel, the greater is the tendency toward the production of deleterious combustion residues. The amount of additive to be combined with the solid fuel will, of course, be greater as any of these disadvantageous situations increases in intensity.

Operable additive dosage rates encompass use of between trace amounts–2.00% (wt %; weight additive: weight ash). The lower levels will be operable in shot-feeding applications. Preferably, the super large MgO particles of the present invention are added within a range of about 0.2%–1.0%.

EXAMPLES

The invention will be further illustrated by the following examples which are included as being illustrative of the invention but which should not be construed as limiting the scope thereof.

Sintering Test and Fly Ash Analysis

In order to gauge the efficacy of the super large MgO particles of the present invention in increasing the friability of coal ash deposits, these particles, in addition to smaller size MgO furnace additives, were subjected to a sintering test. This test (proposed by Barnhart and Williams, see Trans. of the ASME, 78, p 1229–36; August 1956) is intended to determine the tendency of a particular ash to form hard, bonded deposits in the convection sections of coal-fired boilers.

Higher compressive forces needed to burst similar pellets are indicative of more severe fouling problems when compared to similar pellets which are burst via lower compressive forces. In this manner, the relative efficacies of different fuel additive in minimizing the deleterious effects of combustion ashes may be determined by comparing pellet sintering strengths for each additive.

The sintering tests reported hereinbelow were conducted with the additive material mixed intimately with the ash. This approach approximates that of a continuous additive feed condition.

Analysis of the fly ash samples taken from the three boilers used for testing revealed the following:

| | % |
|---|---|
| Fly Ash "A" | |
| Silicon, as $SiO_2$ | 42 |
| Aluminum, as $Al_2O_3$ | 19 |
| Iron, as $Fe_2O_3$ | 19 |
| Titanium, as $TiO_2$ | 1 |
| Calcium, as CaO | 8 |
| Magnesium, as MgO | 1 |
| Sodium, as $Na_2O$ | 3 |
| Potassium, as $K_2O$ | 1 |
| Phosphorous, as $P_2O_5$ | 1 |
| Sulfur, as $SO_3$ | 5 |
| Fly Ash "B" | |
| Silicon, as $SiO_2$ | 34 |
| Aluminum, as $Al_2O_3$ | 11 |
| Iron, as $Fe_2O_3$ | 17 |
| Titanium, as $TiO_2$ | 1 |
| Calcium, as CaO | 12 |
| Magnesium, as MgO | 1 |
| Sodium, as $Na_2O$ | 4 |
| Potassium, as $K_2O$ | 1 |
| Sulfur, as $SO_3$ | 18 |
| Fly Ash "C" | |
| Silicon, as $SiO_2$ | 45 |
| Aluminum, as $Al_2O_3$ | 11 |
| Iron, as $Fe_2O_3$ | 10 |
| Calcium, as CaO | 8 |
| Magnesium, as MgO | 6 |
| Sodium, as $Na_2O$ | 8 |
| Potassium, as $K_2O$ | 1 |
| Phosphorous, as $P_2O_5$ | 1 |
| Sulfur, as $SO_3$ | 8 |

-continued

| | % |
|---|---|
| L.O.I. | 1 |

The results of the sintering strength tests are reported in Tables I–III below. In all instances in these tests, the additives were intimately mixed with the ash in an amount of 1% (by weight additive to weight ash). The % reduction in sintering strength resulting from utilization of the tested additives was calculated by recording the compressive force needed to burst untreated pellets, and comparing that value to the compressive force needed to burst treated pellets sintered at the same temperature.

TABLE I

Sintering Strength Reduction of Ash "A" by Size Classified Calcined MgO* (Baymag 30)

| Particle Size Range Microns | Crushing Temperature (°F.) | Sintering Strength Reduction** (%) |
|---|---|---|
| 75–106 | 1100 | −6 |
| | 1300 | −21 |
| 106–150 | 1100 | 6 |
| | 1300 | 0 |
| 150–250 | 1100 | 33 |
| | 1300 | 39 |
| 250–300 | 1100 | 17 |
| | 1300 | 29 |
| 300–1000 | 1100 | 28 |
| | 1300 | 21 |

*treatment level = 1% based on ash wt.
**ash sintered at 1700° F. for 16 hours.

TABLE II

Sintering Strength Reduction of Ash "B" by Size Classified Dead Burned MgO (MagChem 10 Prilled 30)*

| Particle Size Range Microns | Crushing Temperature (°F.) | Sintering Strength Reduction** (%) |
|---|---|---|
| <150 | 1100 | 4 |
| | 1300 | 37 |
| 150–250 | 1100 | 40 |
| | 1300 | 68 |
| 250–300 | 1100 | 51 |
| | 1300 | 82 |
| 250–300 | 1100 | 17 |
| | 1300 | 29 |
| 300–1000 | 1100 | 62 |
| | 1300 | 78 |

*treatment level = 1% based on ash wt.
**ash sintered at 1700° F. for 16 hours.

In order to contrast the performance of the super large MgO particles of the invention with conventional MgO additives, comparative studies were undertaken. A reagent MgO, namely Baker 65P, was contrasted to BAYMAG3 magnesium oxide particles in performance. The particle size distribution of Baker 65P is as follows:

| Particle Size Microns | Percent Greater Than (Mass Basis) |
|---|---|
| 4 | 90 |
| 8 | 61 |
| 10 | 49 |
| 15 | 29 |
| 30 | 10 |

-continued

| Particle Size Microns | Percent Greater Than (Mass Basis) |
|---|---|
| 40 | 3 |

The results of this comparative study appear in Table III hereinbelow:

TABLE III

Sintering Strength Reduction of Ash "C"

| | Sintering Strength Reduction % Crushing Temperature (°F.) | | | | |
|---|---|---|---|---|---|
| Treatment | 1100 | 1300 | 1500 | 1700 | 1900 |
| Baymag 30 | 37 | 35 | 27 | 18 | 35 |
| Baker 65P | 6 | 13 | 14 | 18 | 20 |

It is apparent that the use of super large MgO particles results in significantly better performance in reducing the force required to burst the tested pellets. Specifically, MgO treatment is effective when the major mass fraction of the MgO is on the order of 150 microns in diameter and greater.

Although the efficacy of the present invention has been demonstrated by the use of two particular commercially available magnesium oxide products, the skilled artisan will appreciate that any such magnesium oxide products will prove effective, in accordance with the invention provided that the major mass fraction thereof is on the order of 150 microns in diameter and greater.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

We claim:

1. Method of minimizing the deleterious effects of combustion residues on structures normally contacted thereby, comprising burning coal in a furnace combustion zone, and adding to said furnace an effective amount of a magnesium oxide material comprising particles the major mass fraction of which is about 150 microns in diameter or greater so as to increase the friability of said residues which may normally adhere to said structures.

2. Method as defined in claim 1 comprising burning said coal in a boiler furnace of the type having a convection zone located downstream from said combustion zone, and adding said magnesium oxide material at a location upstream from said convection zone.

3. Method as defined in claim 1 comprising burning said coal in a boiler furnace and adding said magnesium oxide directly to said fuel in said combustion zone.

4. Method as defined in claim 1 comprising adding between about trace–2.0% by weight of said particles based upon the weight of said combustion products.

5. Method as defined in claim 4 comprising adding between about 0.2%–1.0% by weight of said particles based upon the weight of said combustion products.

6. Method as defined in claim 1 wherein said step of adding comprises mixing said additive with said coal.

7. Method as defined in claim 6 wherein said mixing comprises periodically mixing said additive with said coal.

8. Method as defined in claim 6 wherein said mixing comprises continuously mixing said additive and said coal.

9. In a coal fired boiler of the type having a combustion zone in which said coal is fired, a convection zone located downstream from said combustion zone and having a plurality of heater tubes disposed in said convection zone and adapted to heat water or steam disposed therein, and in which convection zone combustion residues emanating from said coal have a tendency to stick to or agglomerate upon said tubes, a method of decreasing said tendency to stick or agglomerate, comprising burning said coal in the presence of an additive consisting essentially of magnesium oxide particles, the major mass fraction of which is about 150 microns in diameter or greater.

10. Method as defined in claim 9 comprising feeding said additive at a location disposed upstream from said convection zone.

11. Method as defined in claim 9 comprising adding between about trace–2.0% by weight of said particles based upon the weight of said combustion residues.

12. Method as defined in claim 11 comprising adding between about 0.2%–1.0% by weight of said particles based upon the weight of said combustion residues.

13. Method as defined in claim 9 comprising mixing said additive and said coal and admitting them to said combustion zone.

14. Method as defined in claim 13 wherein said mixing comprises continuously mixing said additive and said coal.

15. Method as defined in claim 13 wherein said mixing comprises periodically mixing said additive and said coal.

* * * * *